US006056594A

United States Patent [19]

Ching

[11] Patent Number: 6,056,594

[45] Date of Patent: May 2, 2000

[54] CONNECTOR STRUCTURE

[75] Inventor: Lin Ming Ching, Taipei Hsien, Taiwan

[73] Assignee: C.S. Conser Enterprise Co., Ltd., Taipei Hsien, Taiwan

[21] Appl. No.: 09/238,017

[22] Filed: Jan. 26, 1999

[51] Int. Cl.[7] ..... H01R 13/66

[52] U.S. Cl. ..... 439/541.5

[58] Field of Search ..... 439/541.5, 939, 439/540.1, 80, 95, 101, 108, 567, 638

[56] References Cited

U.S. PATENT DOCUMENTS

| | | | |
|---|---|---|---|
| 5,145,412 | 9/1992 | Tan et al. | 439/620 |
| 5,643,008 | 7/1997 | Tan et al. | 439/541.5 |
| 5,695,362 | 12/1997 | Hillbish et al. | 439/541.5 |
| 5,791,919 | 8/1998 | Brisson et al. | 439/166 |

*Primary Examiner*—Steven L. Stephan
*Assistant Examiner*—Chandrika Prasad
*Attorney, Agent, or Firm*—Rosenberg, Klein & Lee

[57] ABSTRACT

A connector structure comprises a base, a D connector arranged at one portion of the base and a plurality of audio connectors arranged transversely another portion layer of the base, wherein the audio connector comprises a metal frame arranged on the mounting hole of the base, a metal pipe looped with plastic ring having identification color riveted to the metal frame, and a ground plate sandwiched therebetween. The ground plate is firmly arranged between the metal pipe and the metal frame. The contact area between the ground plate and the metal frame is increased and the grounding will not be affected by the disturbance of the ground plate or the ground terminal. Moreover, the ground plate can be rotated with respect to the metal pipe to change the location of the elastic plate such that optimal contact between the elastic plate and the case can be achieved. The surface of the metal pipe is formed with concave and convex rings such that plastic ring with identification color can be arranged thereon according to the practical circuit layout.

6 Claims, 6 Drawing Sheets

CONNECTOR STRUCTURE

FIELD OF THE INVENTION

The present invention relates to an improved connector structure, more particularly, to a stacking-type connector comprising a D connector on upper layer and a plurality of audio connectors on lower layer.

BACKGROUND OF THE INVENTION

FIG. 1 shows a conventional stacking type connector which comprises a high density (high pin number) D connector 11 on a base 10 and a plurality of audio connectors 12 arranged transversely with respect to the D connector 11. The audio connectors 12 are a plurality of plastic tubes 120 formed by mold injection from the bottom of the base 10 and having different colors for identification. A plurality of grooves 101 are arranged at one end of the base 10 and in front of the conductive terminal 100. The grooves 101 are connected with the dents 102 on bottom side of the plastic tubes 120 and each contains a ground plate 121. The ground plate 121 is of U shape and has one end being pressed to form a ⟍-shaped elastic plate 122 and another end extending to form an L-shape contact plate 123. The elastic plate 122 projects into the dent 102 and the contact plate 123 is in spot-contact with the ground terminal 103 when the ground plate 121 is placed within the groove 101.

However, the above-mentioned connector structure has following drawbacks.

First, the ground plate 121 is in contact to the narrow ground terminal 103 with the narrow contact plate 123 thereof in a spot-contact fashion. The contact area therebetween is too small and the problem of poor contact is wont to occur. For example, the ground plate 121 may be obliquely arranged within the groove 101 because there is no suitable guiding means within the groove 101 and the ground plate 121 is arranged into the groove simply by pushing. Therefore, the contact plate 123 is hard to substantially contact the ground terminal 103. Otherwise, the contact plate 123 will have poor contact with the ground terminal 103 if the ground terminal 103 is shifted or bent.

Moreover, as shown in FIG. 2, the elastic plate 122 of the ground plate 121 is placed within the dent 102 below the plastic tube 120 of the audio connector 12 in order to contact to the case 20. However, the elastic plate 122 is placed within the concave dent 102 and exposes on portion thereof outside the dent 102. Therefore, the elastic plate 122 has only small area of contact with the case 20 and is wont to be buried within the dent 102 caused by the pressing of the case 20 or the elastic deformation thereof. The ground effect is accordingly degraded. Moreover, the elastic plate 122 is permanently arranged adjacent the plastic tube 120, the position thereof is hard to adjust to match the best contact position with the case 20.

Furthermore, the tube 120 of the audio connector 12 are formed integrally with the base 10 by mold injection, thus limit the color selection thereof. This makes the product hard to have plentiful color.

In one aspect of the present invention, the inventive audio connector comprises a metal frame arranged on the mounting hole of the base, a metal pipe riveted to the metal frame, and a ground plate sandwiched therebetween. The ground plate is firmly arranged between the metal pipe and the metal frame. The contact area between the ground plate and the metal frame is increased and the grounding will not be effected by the skewness of the ground plate or the ground terminal.

In another aspect of the present invention, an elastic plate is formed by pressing on one end of the ground plate. The elastic plate can be wholly extruded out of the front surface of the base and has large contact area with the case. Moreover, the ground plate can be rotated with respect to the metal pipe to change the location of the elastic plate such that optimal contact between the elastic plate and the case can be achieved.

In still another aspect of the invention, the surface of the metal pipe is formed with concave and convex rings such that plastic ring with identification color can be arranged thereon according to the practical circuit layout.

The various objects and advantages of the present invention will be more readily understood from the following detailed description when read in conjunction with the appended drawing, in which:

DETAIL DESCRIPTION OF PREFERRED EMBODIMENT

Figure 1:
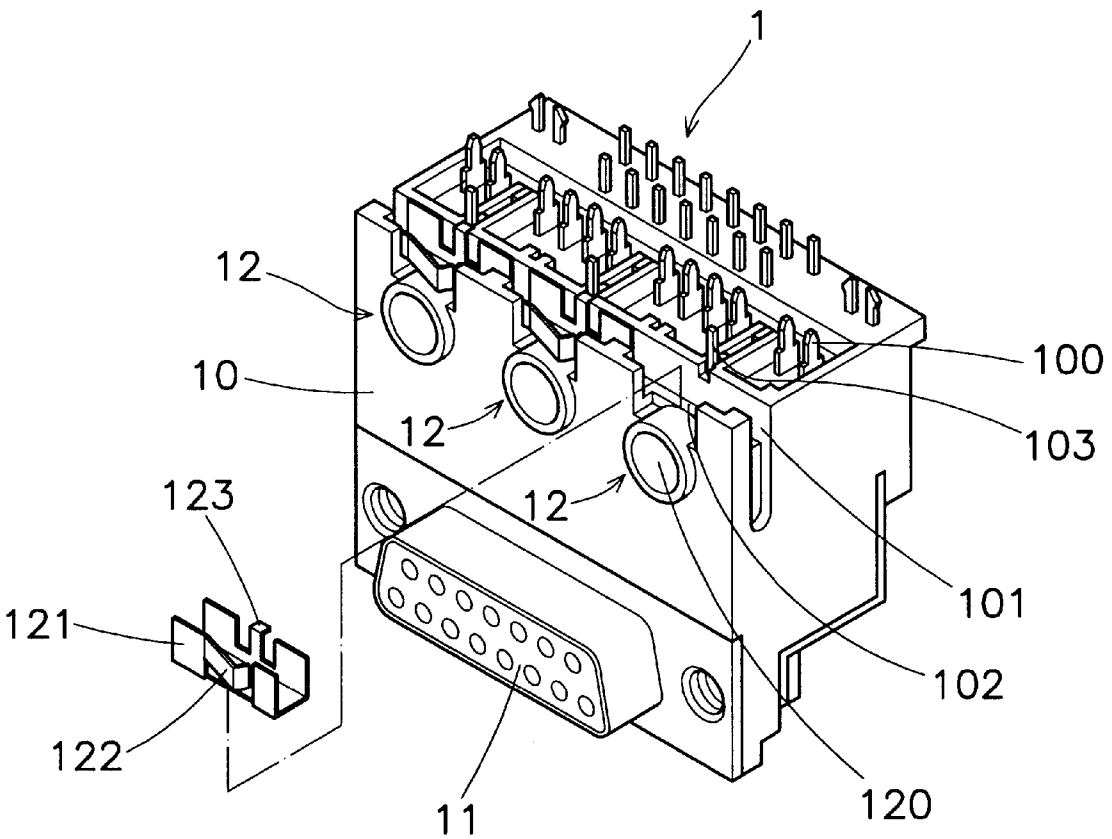
FIG. 1 PRIOR ART
FIG. 1 shows the bottom perspective view of the conventional connector.
Figure 2:
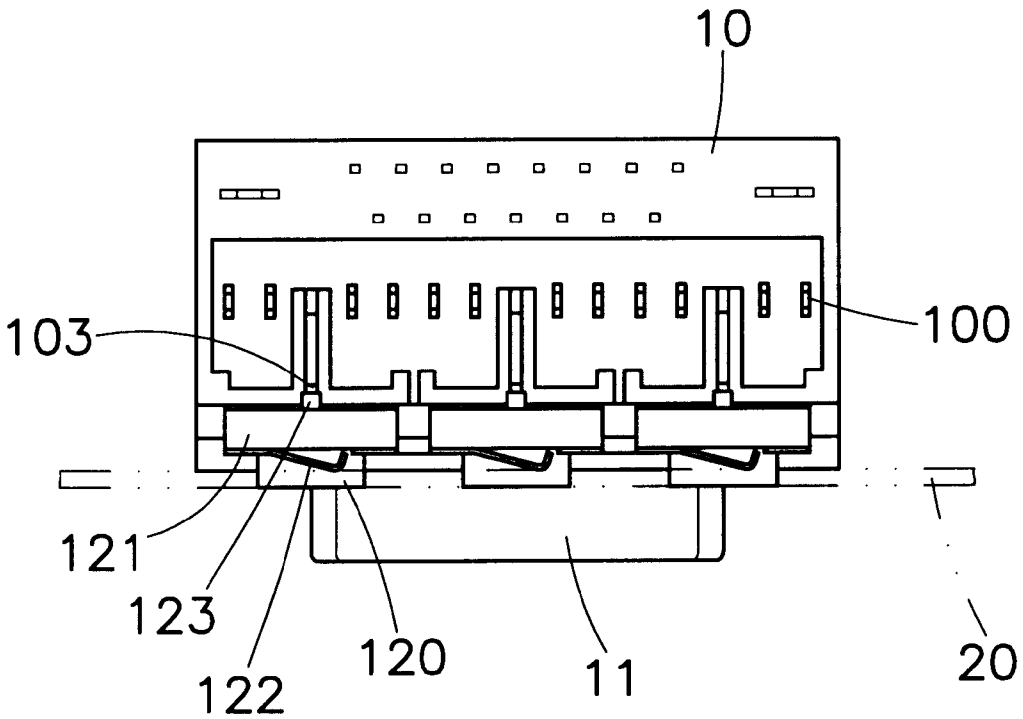
FIG. 2 PRIOR ART
FIG. 2 shows the bottom plan view of the conventional connector.
Figure 3:
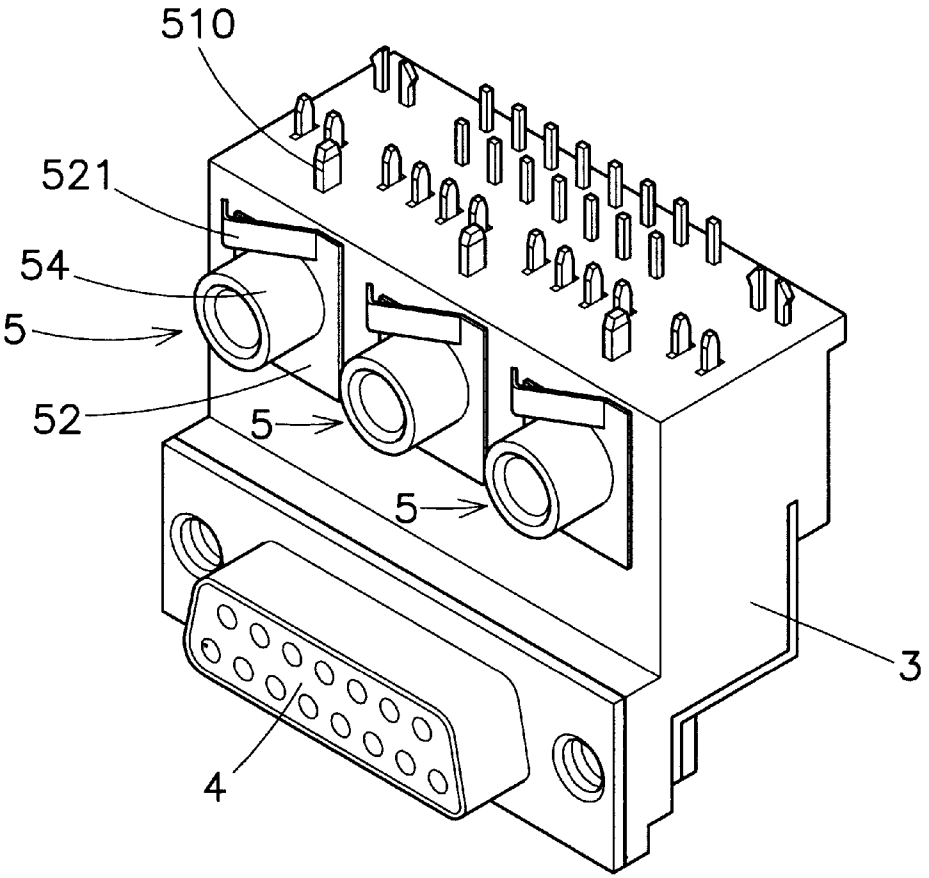
FIG. 3 shows the bottom perspective view of the inventive connector.
Figure 4:
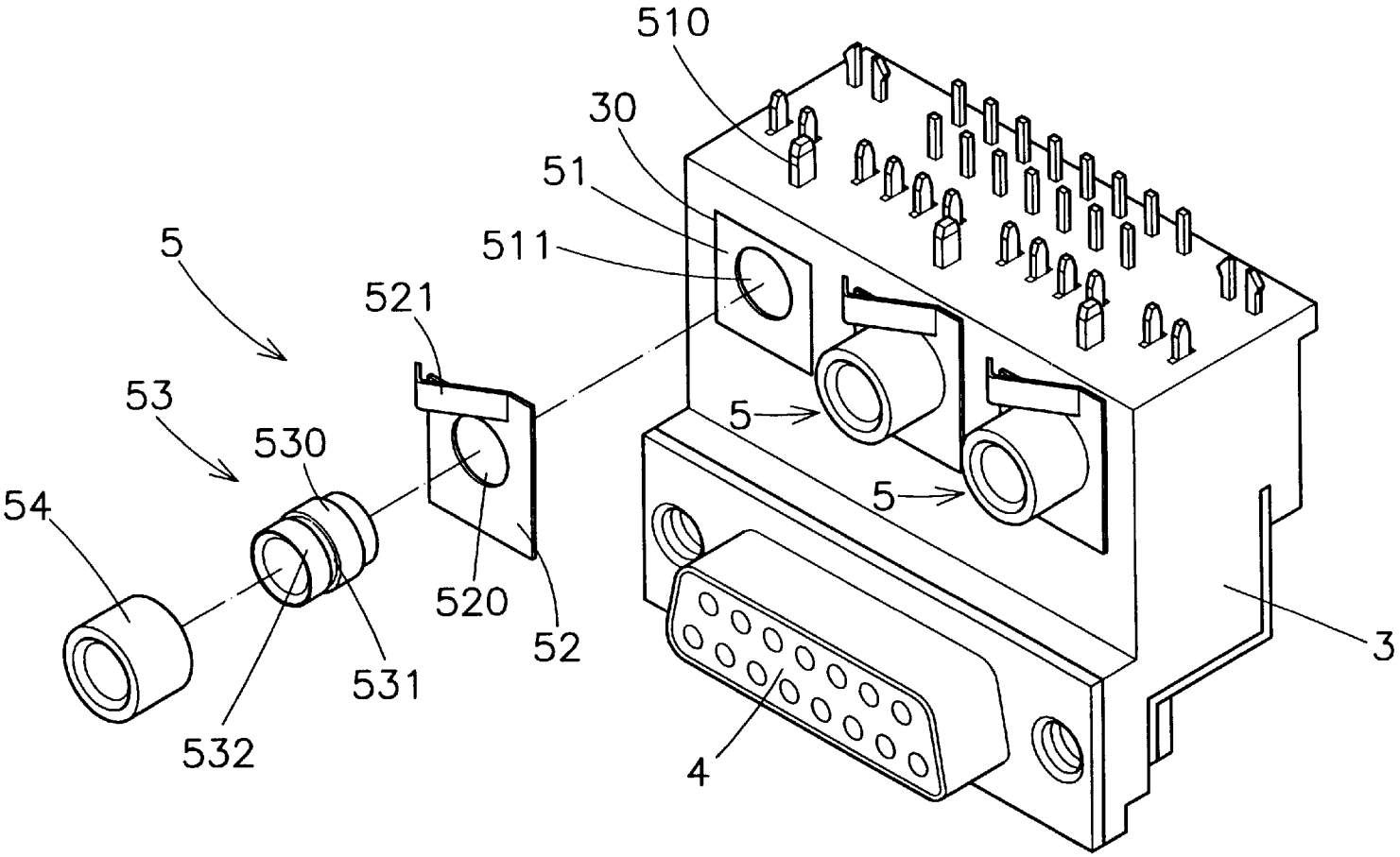
FIG. 4 shows the bottom exploded view of the inventive connector.

As shown in FIGS. 3 and 4, those pictures show the perspective view and the exploded view of the inventive connector. The inventive connector comprises a base 3, a D connector 4 and a plurality of audio connectors 5 arranged transversely adjacent the base 3.

The audio connector 5 comprises a metal frame 51 having an opening 511 arranged within the assembling hole 30 formed in the base 3, which is provide for the arrangement of the audio connector 5. The metal frame 51 further comprises a ground terminal 510 extending therefrom to project out of one end of the base 3. A metal ground plate 52 with through hole 520 attaches on the rear side of the metal frame 51 and a metal pipe 53 passes through the through holes 520 and opening 511 and is riveted to the metal frame 51 such that the ground plate 52 is rotatably sandwiched between the metal pipe 53 and the metal frame 51. The ground plate 52 has a ⟍-shaped elastic plate 521 formed on one end thereof by pressing.

Figure 5:
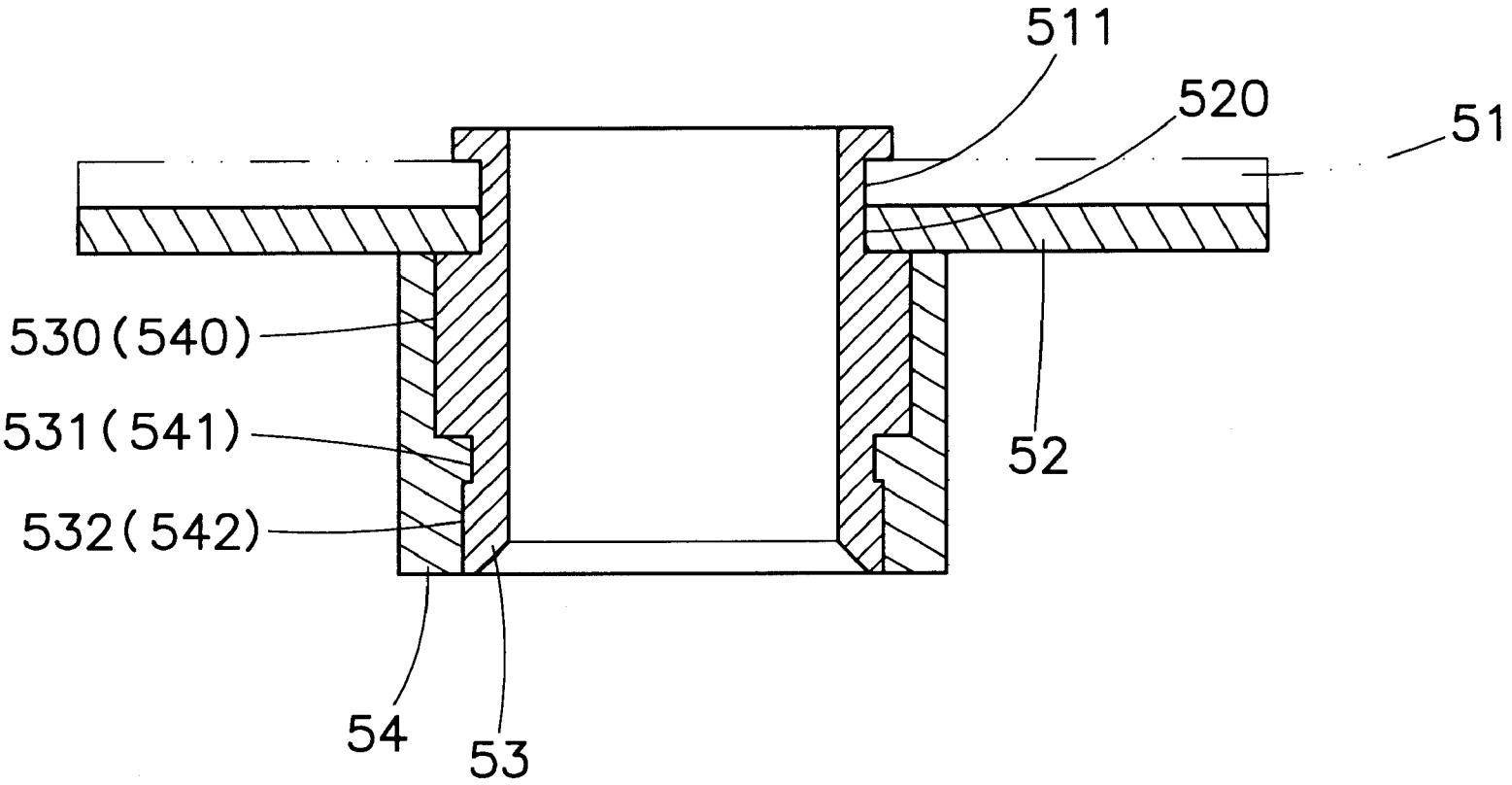
FIG. 5 shows the partially cross section view of the audio connector in the present invention.

Moreover, a first convex ring 530, a concave ring 531, and a second convex ring 532 is formed surrounding the metal pipe 53, and plastic colored ring 54 with same number with the metal pipes 53 and different color for identification are provided. Each plastic colored ring 54 has a first concave ring 540, a convex ring 541 and a second concave ring 542 formed on inner annulus thereof and corresponding to the metal pipe 53. As shown in FIG. 5, the plastic ring 54 is covered over the corresponding metal pipe 53 such that the wiring of audio circuit can be matched.

The inventive connector with above-mentioned structure has following advantages.

First, the ground plate of the invention is connected to the ground terminal 510 integrally formed with the metal frame 51 in a surface contact fashion with the help of the metal pipe 53. Therefore, the contact area between the ground terminal 510 and the ground plate 52 is advantageously increased. Moreover, the ground plate 52 is firmly sandwiched between the metal pipe 53 and the metal frame 51 wherein the metal pipe 53 is riveted on the metal frame 51. The contact area between the ground plate 52 and the metal frame 51 can be kept sufficiently large even though the metal pipe 53 is loosened or the ground terminal 510 is bent. The contact area is enhanced with security.

Figure 6:
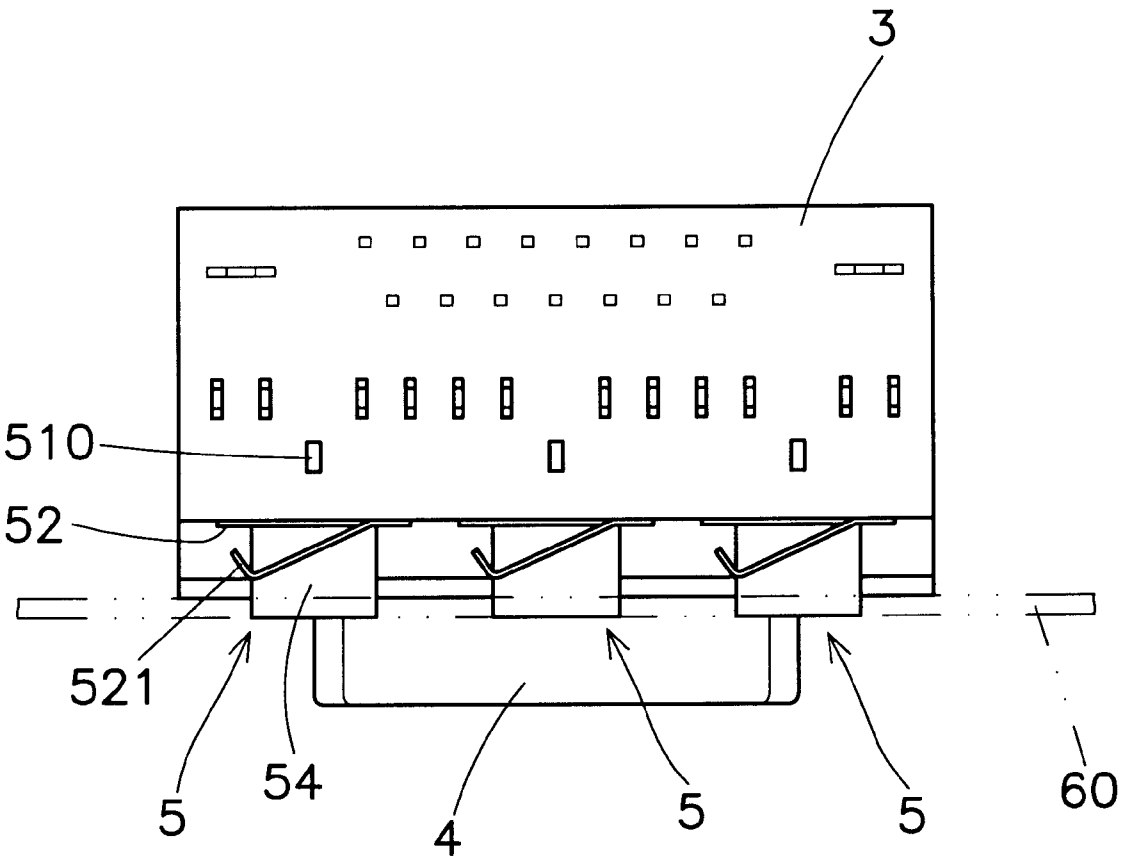
FIG. 6 shows the bottom plan view of the inventive connector.

Secondly, the ground plate 52 of the invention is sandwiched between the metal pipe 53 and the metal frame 51, that is, the ground plate 52 is positioned abutting to the front surface of the base 3. Therefore, the elastic plate 521 of the ground plate 52 always extrude out of the front surface of the base 3. As shown in FIG. 6, the elastic plate 521 will be kept in contact with the case 60 when the case 60 is pressed over the elastic plate 521. When the pressing force of the case 60 against the elastic plate 521 increases, the contact area therebetween increases. Moreover, the relative position between the audio connector 5 and the case 60 may be varied according to different unit. The ground plate 52 of the invention can rotate with respect to the metal pipe 53 such that the position of the elastic plate 521 can be adjusted flexibly in upper/lower direction or right/left direction such that an optimal contact between the elastic plate 521 and the case 60 can be achieved.

Third, the plastic colored ring 54 for the identification of audio connector 5 is arranged on the metal pipe 53 in attaching fashion such that plastic ring 54 with suitable color are selectively arranged on the corresponding metal pipe 53 without being limited by the existing layout of the connector or the circuit board. Therefore, the prevent invention is more flexible in application and has a lower cost.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A connector assembly comprising:

(a) a base having a plurality of assembling holes formed therein;

(b) a plurality of audio connectors coupled to said base, each said audio connector including:

(1) a metal frame received within one said assembling hole of said base, said metal frame having formed therein an opening communicating with said assembling hole, said metal frame having a ground terminal disposed to extend from said base;

(2) a metal ground plate coupled to said metal frame, said metal ground plate having an elastic plate portion formed thereon; and, (3) a transversely extended metal pipe capturing said metal ground plate against said metal frame, at least a portion of said metal pipe passing through said metal ground plate and engaging said metal frame opening; and, (c) a supplemental connector coupled to said base.

2. The connector assembly as recited in claim 1 wherein said metal ground plate has formed therein a through hole substantially aligned with said metal frame opening, said through hole receiving said portion of said metal pipe therethrough.

3. The connector assembly as recited in claim 2 wherein said metal ground plate is angularly adjustable about said portion of said metal pipe, whereby said elastic plate portion of said metal pipe is adjustably displaceable.

4. The connector assembly as recited in claim 1 further comprising at least one plastic ring having a substantially tubular contour and a predetermined color coaxially engaging one said metal pipe.

5. The connector assembly as recited in claim 4 wherein said metal pipe includes an outer surface having axially displaced first and second convex ring portions and an intermediate concave ring portion disposed therebetween.

6. The connector assembly as recited in claim 5 wherein said plastic ring includes an inner surface having axially displaced first and second concave ring portions and an intermediate convex ring portion disposed therebetween for respectively engaging said first convex, second convex, and intermediate concave ring portions of said metal pipe.

* * * * *